United States Patent [19]

Hill

[11] Patent Number: 5,024,203

[45] Date of Patent: Jun. 18, 1991

[54] PCV OIL SEPARATOR SYSTEM

[75] Inventor: Stephen H. Hill, Muskegon, Mich.

[73] Assignee: Sealed Power Technologies, L.P., Muskegon, Mich.

[21] Appl. No.: 571,322

[22] Filed: Aug. 22, 1990

[51] Int. Cl.[5] ..... F02M 25/00

[52] U.S. Cl. ..... 123/573; 123/572

[58] Field of Search ..... 123/572, 573, 574, 557, 123/549

[56] References Cited

U.S. PATENT DOCUMENTS

| | | | |
|---|---|---|---|
| 3,088,447 | 5/1963 | Henderson | 123/573 |
| 4,627,406 | 12/1986 | Namiki et al. | 123/572 |
| 4,768,493 | 9/1988 | Ohtaka et al. | 123/573 |

*Primary Examiner*—Andrew M. Dolinar
*Assistant Examiner*—M. Macy
*Attorney, Agent, or Firm*—Barnes, Kisselle, Raisch, Choate, Whittemore & Hulbert

[57] ABSTRACT

An oil separator positioned in the positive crankcase ventilation (PCV) system adjacent the engine such that the oil separator is subjected to a predetermined minimum operating temperature. The oil separator comprises an opening through which the oil, fuel and water particles pass with the gas stream. The oil separator is constructed and arranged to cause the oil particles to strike an impactor plate and be separated from the gas flow while fuel and water particles pass on through the system and re-enter the engine.

25 Claims, 5 Drawing Sheets

PCV OIL SEPARATOR SYSTEM

This invention relates to positive crankcase (PCV) ventilation systems and particularly to such systems incorporating an oil separator.

BACKGROUND OF THE INVENTION

Automotive engines use a closed or positive crankcase ventilation (PCV) system to insure that harmful vapors do not escape into the environment. A typical prior art PCV system is shown in FIG. 1. The PCV system establishes a direct flow path from the engine crankcase to the intake manifold to insure positive ventilation. Flow is induced by the differential pressure between the intake manifold and the crankcase. Total flow through the PCV system is made up of fresh air (where supplied), blow-by past piston rings, and a mist of oil, water, and gasoline from the crankcase. Testing has shown that a substantial amount of oil can be contained in the PCV gas flow; and that the level of oil being consumed through the PCV system is a significant contributor to overall oil consumption in many engines.

A number of patents have been issued for devices used to remove liquid from PCV gases or gases originating from the engine crankcase. Namiki et al U.S. Pat. No. 4,627,406 uses offset baffles and a barrier, coalescing filter to remove liquid from the PCV gas stream. Katoh et al. U.S. Pat. No. 4,502,424 uses baffles with double outlets from the crankcase to insure ventilation under extreme engine angles. Gates Jr. et al. U.S. Pat. No. 4,401 093 uses a labyrinth plus barrier filter at the oil fill/breather cap to remove liquid. Walker U.S. Pat. No. 4,269,607 uses reverse flow and varying flow areas to remove liquid from gas in the PCV system. Bush U.S. Pat. No. 4,089,309 uses baffles plus a glass bead screen to separate liquid from PCV gas. Lipscomb U.S. Pat. No. 3,877,451 uses a barrier filter for removal of liquid from PCV gas. Otofy U.S. Pat. No. 4,765,386 is based on the use of a wire mesh barrier filter. An earlier patent by Walker U.S. Pat. No. 3,721,069 uses baffling with a barrier filter. Bruenn U.S. Pat. No. 3,299,873 uses a labyrinth and baffles for the same purpose. Jackson U.S. Pat. No. 3,179,097 uses a labyrinth to "precipitate" oil out of a system designed to modulate crankcase pressure or vacuum. Henderson U.S. Pat. No. 3,088,447 feeds crankcase vapors through a needle valve and barrier filter to an electrically heated screen below the carburetor for vaporization and subsequent combustion. Beckett U.S. Pat. No. 2,604,186 controls crankcase gas flow with a variable orifice device which is protected by a barrier filter. Schreurs U.S. Pat. No. 2,041,435 separates liquid from vaporized fuel at the carburetor inlet with a brass barrier filter and baffling. Tracy U.S. Pat. No. 1,427,337 uses a baffled, vacuum controller to regulate crankcase flow to the intake manifold.

In all of these patents, the technique used to separate liquid from gas is either baffles, barrier filters, labyrinths, or a combination of these. None of the patents uses precise, scientific design techniques to configure an inertial impactor for separation based on particle or droplet size. In general, baffles or labyrinths will have low filtration efficiency. Barrier filters can produce high filter efficiency but require more space to accomplish this with low restriction. Increased size makes packaging the filter around the engine more difficult. Barrier filters contain filter elements which are subject to plugging and icing; and must be cleaned or changed at frequent intervals.

None of the patents recognizes the need to prevent fuel and water from being collected with the oil; and none suggests the use of heat to condition the incoming sample so that oil is collected and fuel and water are not.

Accordingly, among the objectives of the present invention are to provide a PCV oil separator system wherein oil particles are separated from the PCV flow while fuel and water particles pass on through the system to re-enter the engine; wherein the modification to the conventional PCV oil separator system is minimal; wherein the modification may be made at low cost.

In accordance with the invention, the positive crankcase ventilation system includes an oil separator positioned adjacent the engine such that the oil separator is subjected to a predetermined minimum operating temperature. The oil separator comprises an opening through which the oil, fuel and water particles pass in the PCV gas flow. The oil separator is constructed and arranged to cause the oil particles to strike an impactor plate and to be separated from the gas flow while fuel and water particles pass on through the system and reenter the engine.

DESCRIPTION

Figure 1:
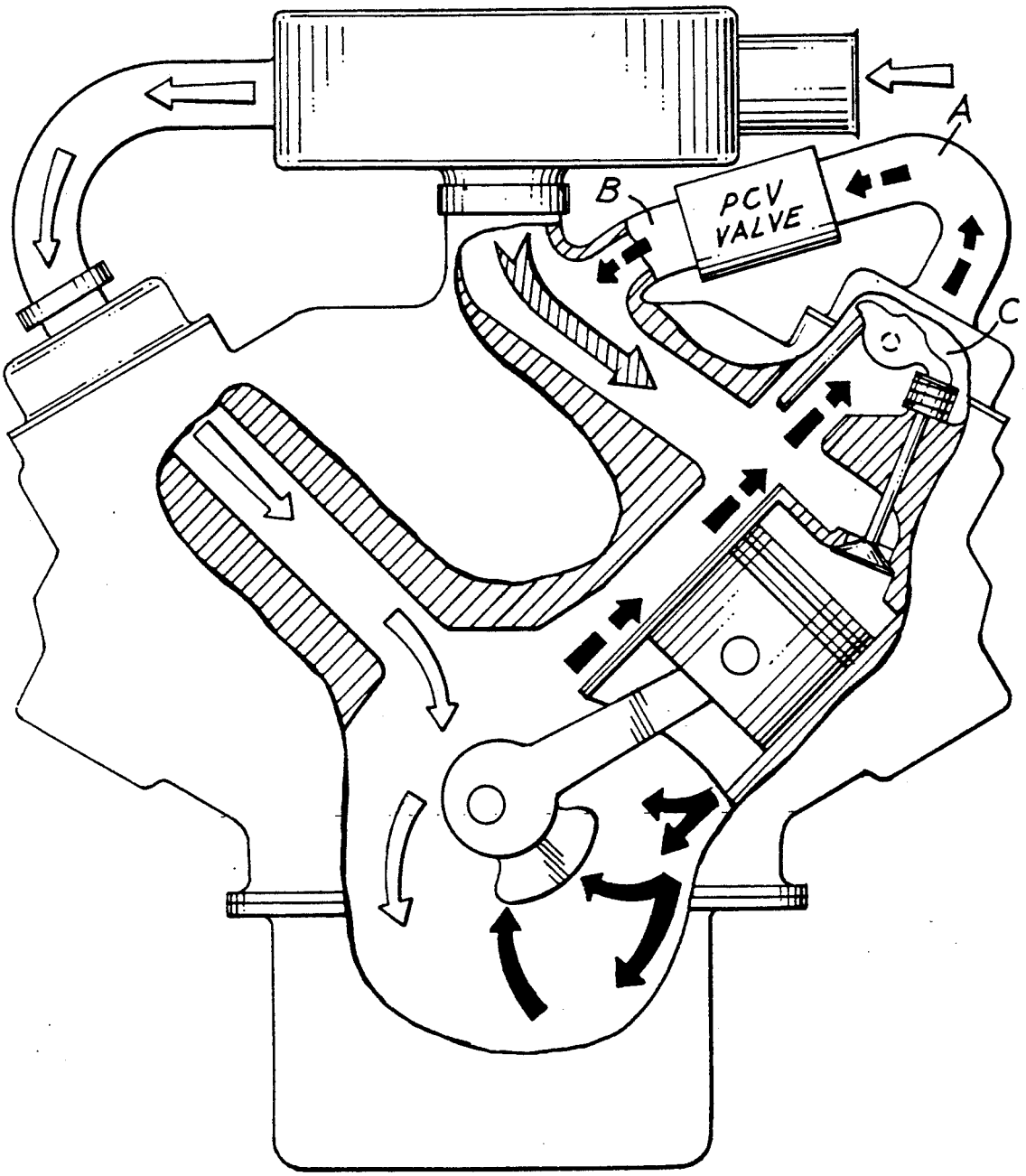
FIG. 1 is a schematic view of a PCV crankcase ventilation system embodying the invention.

In accordance with the invention, a PCV oil separator S separates the oil from air flow while allowing passage of water, gasoline, and gaseous combustion products. Referring to FIGS. 1-10, the oil separator S is positioned as presently described such that a mixture of PCV gas flow containing oil, fuel, and water particles pass through the housing 10 of separator S, having an inlet 11 and an outlet 12. An orifice plate 13 is positioned adjacent the inlet 11 and has a chamfered orifice 14 through which the PCV mixture passes upon or around an impactor plate 15 positioned such that the oil particles are directed against the impactor plate. The housing 10 directs and contains the PCV flow, and houses the orifice and impactor plates. The orifice plate 13 is sealed to the inside diameter of the housing so that all PCV flow must pass through the orifice 14. The impactor plate 15 collects oil which drains by gravity into a drain system. Impactor plate 15 has a cross section less than that of the housing and includes vertical flanges 15*a* extending toward orifice plate 13, for purposes presently described.

Figure 5:
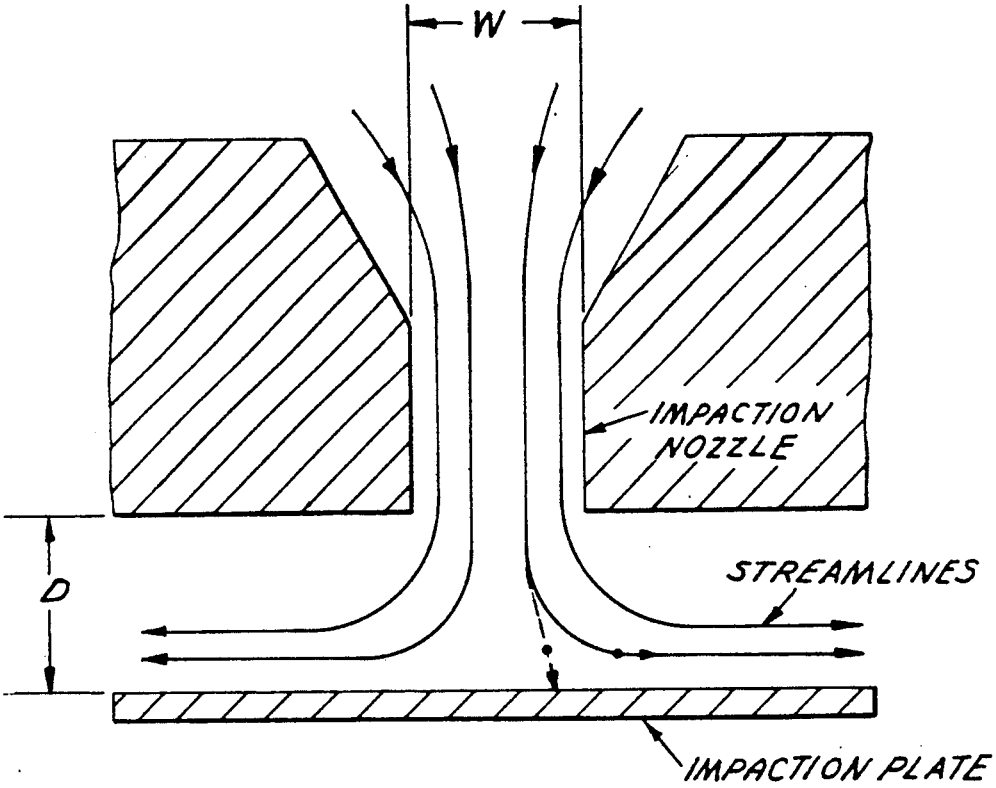
FIG. 5 is a diagrammatic view of the functioning of the oil separator.

Orifice plate 13 and impactor plate 15 together form an inertial impactor. A schematic view of such an inertial impactor is shown in FIG. 5.

By proper selection of orifice size (W) and spacing between orifice and impactor plates (D), particles greater than a minimum aerodynamic diameter collide with the impactor plate and are collected, while smaller particles avoid the impactor plate and pass through the device. A chamfer 14*a* is required on the inlet to the orifice 14 to provide consistent, predictable flow through the orifice.

Figure 10:
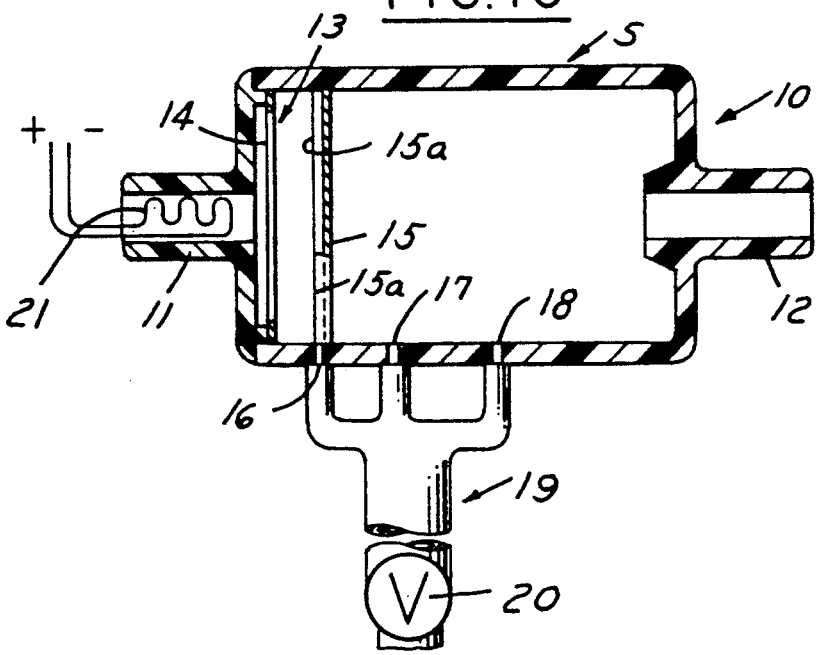
FIG. 10 is a longitudinal sectional view of the oil separator including an electrical heat source.

The drain system consists of the drainage passages 16, 17, 18 in the housing 10, a reservoir 19, and a drain valve 20. The reservoir 19 must have sufficient capacity to hold the maximum amount of oil collected between drain opportunities. The drain valve 20 is used to empty the reservoir, and is required to seal a potential, undesirable flow path between crankcase and intake manifold which would bypass the oil separator and PCV valve, thereby exposing the engine crankcase to high levels of intake manifold vacuum. A heating system is used to maintain a minimum operating temperature. This system is required to reduce particle size of water and fuel constituents which would otherwise be collected with the oil. A number of heat sources can be used including electrical heater 21, as shown in FIG. 10, or waste heat from the engine exhaust or coolant.

Figure 2:
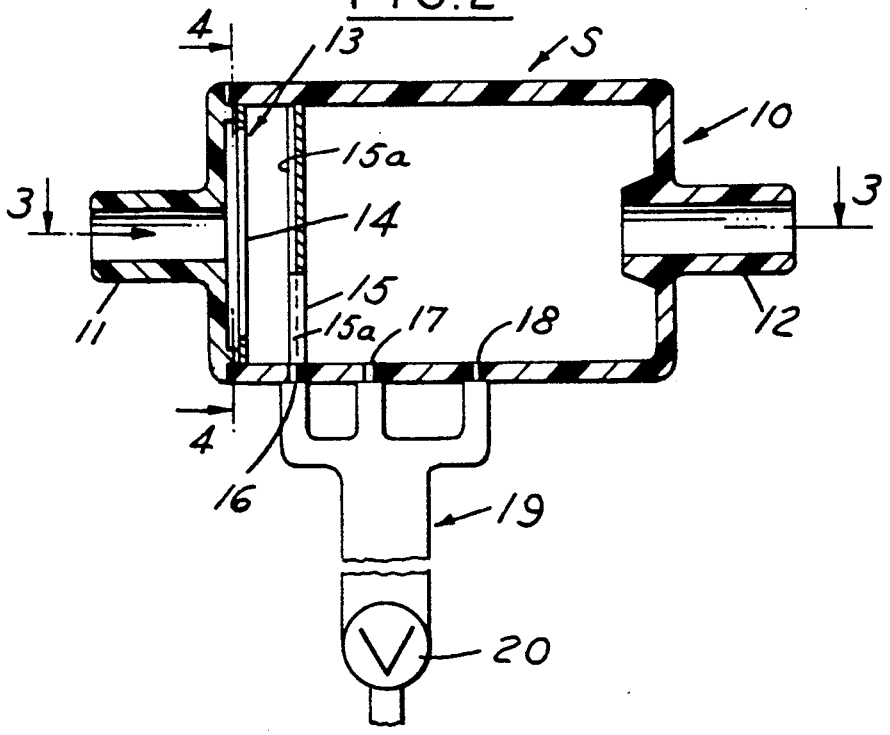
FIG. 2 is a longitudinal sectional view of a oil separator utilized in the system.
Figure 3:
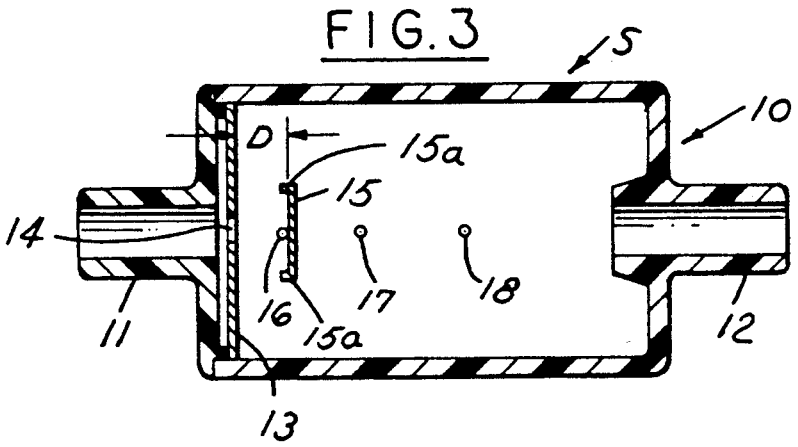
FIG. 3 is a sectional view taken along the line 3—3 in FIG. 2.
Figure 4:
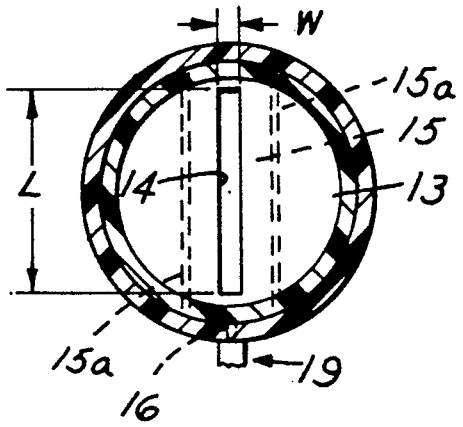
FIG. 4 is a sectional view taken along the line 4—4 in FIG. 2.

The configuration shown in FIGS. 2–4 mounts the oil separator outside the engine in the PCV line. It is also possible to mount the oil separator inside the engine in the PCV flow path. In that alternate configuration, the housing function is performed by the outside diameter of the PCV flow path. With internal mounting of the separator, no oil reservoir or drain valve is required; as the oil drains directly back into the engine oil system. If the required minimum operating temperature is produced by the engine environment in internal installations, the heating system can also be deleted.

POSITION OF UNIT

Figure 6:
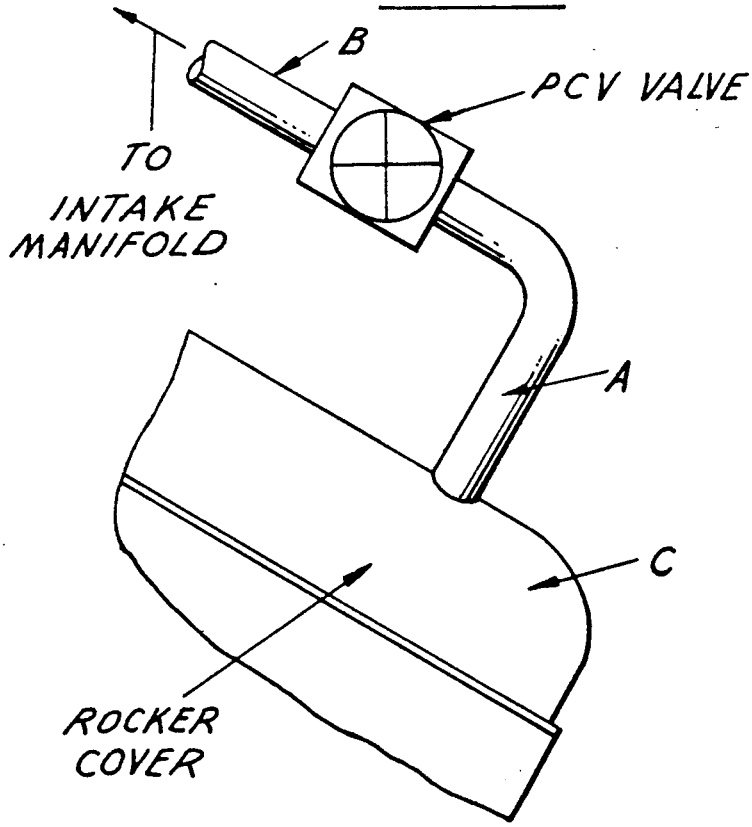
FIG. 6 is a diagrammatic view of possible positions of the oil separator in the engine system.
Figure 7:
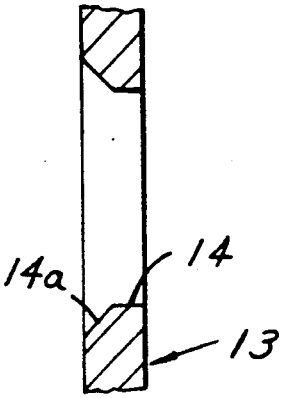
FIG. 7 is a cross-section of the chamfered orifice in the orifice plate.

A typical PCV system is shown in FIG. 1. FIG. 6 is an expanded scale view of the engine area around the PCV valve. Fresh, filtered air mixes with blow-by gases in the engine crankcase. This mixture is pulled from the crankcase through the PCV control valve by intake manifold vacuum. There are three possible locations for the PCV oil separator. The locations external to the engine are labeled as A and B in the FIGS. 1 and 6. Location A is in the PCV flow path between the engine and PCV valve. At this location, the separator S is exposed to minimal vacuum, and heat from the engine will reduce the amount of external heat required. Location B is in the PCV line between the PCV valve and the intake manifold At this location, additional heat will be required to maintain minimum operating temperature and the separator will be exposed to vacuum levels approaching intake manifold vacuum. The third location C is internal to the engine in the PCV flow path. One possible internal engine location at the rocker cover outlet to the PCV system is identified as C in FIGS. 1 and 6.

EXPLANATION OF FUNCTION

In practice, the entire PCV flow is ducted through the orifice 14 in the orifice plate 13. All particles larger than the desired minimum aerodynamic diameter are separated from the air stream by collection at the impactor plate 15. Particles smaller than the minimum aerodynamic diameter pass around the impactor plate 15 with the air stream and are not collected. To insure that desired particles (oil) are collected, and particles not desired (fuel and water) are not collected; the device is maintained at a predetermined minimum operating temperature. The operating temperature is provided by a combination of retained heat in the PCV stream and heat from an external source. Possible external heating sources include electrical radiant heating elements 21 or waste heat from the exhaust or coolant. The temperature required is a function of pressure at the separator, droplet size at the inlet to the separator, size of orifice 14, and the spacing between orifice plate 13 and impactor plate 15. In the case of a slot as an orifice the size comprises a width W and length L. At lower temperatures, the aerodynamic diameter of oil, fuel, and water particles will be similar because of the similar densities. (Specific Gravities=0.82 for oil, 0.77 for fuel, and 1.0 for water.) However, the boiling points or vaporization points vary significantly Water boils at 212° F. The vaporization of gasoline begins at 100° F. and is 80% complete by 275° F. Oil vaporization begins above 400° F. By vaporizing the bulk of fuel and water, droplet sizes for those constituents are reduced below the minimum diameter collected by the separator. This permits the oil collected to be reused. Failure to separate fuel and water from the oil collected would result in rapid contamination of the engine lube oil.

Oil droplets strike the impactor plate 15 and drain into the oil reservoir by gravity being guided by flanges 15*a*. Vaporized fuel and water droplets pass around the impactor plate 15 with the PCV gas stream, re-enter the engine through the intake manifold, and are consumed in combustion. The oil accumulates in the reservoir. At the appropriate time, the oil drain valve 20 opens and the oil collected drains back into the engine crankcase. The oil drain valve can be controlled electrically off the vehicle ignition, by vacuum off the engine intake manifold, or mechanically. The drain valve 20 must be opened only when the engine is not running to avoid bypassing the oil separator and pulling engine oil out of the sump with intake manifold vacuum.

Figure 8:
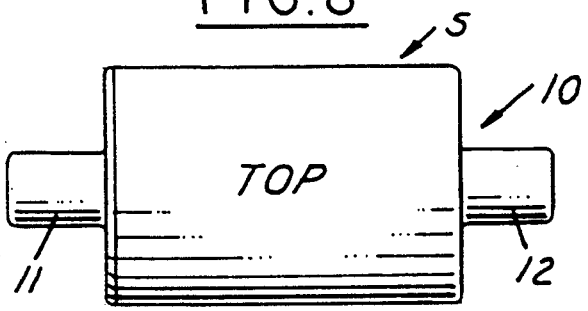
FIGS. 8 and 9 are top and side views, respectively of the separator showing orientation and flow direction indicia.
Figure 9:
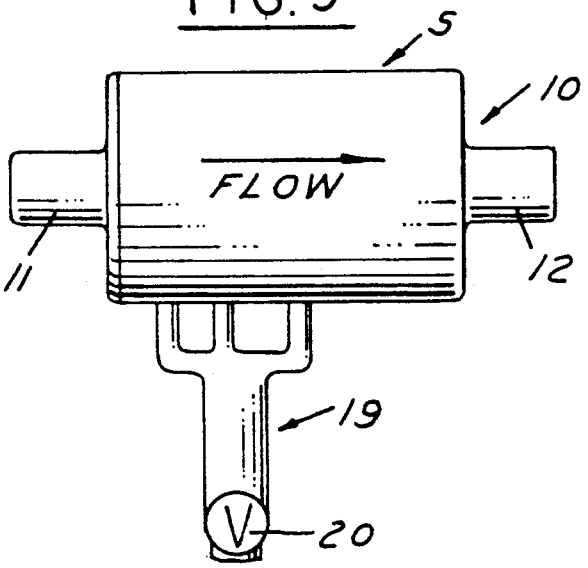

In order to facilitate proper orientation of the rectangular orifice and efficient drainage of oil collected, the housing 10 has suitable indicia indicating direction of flow and the top of the housing as shown in FIGS. 8 and 9. The housing 10 is preferably made of plastic and the indicia are molded on the housing. In order to facilitate assembly, inlet 11 and the associated end wall is made as a separate piece. After assembly of the orifice plate 13 and impactor plate 15, the inlet 11 is bonded or fused to the remainder of the housing.

CURVES OF PERFORMANCE

Figure 11:
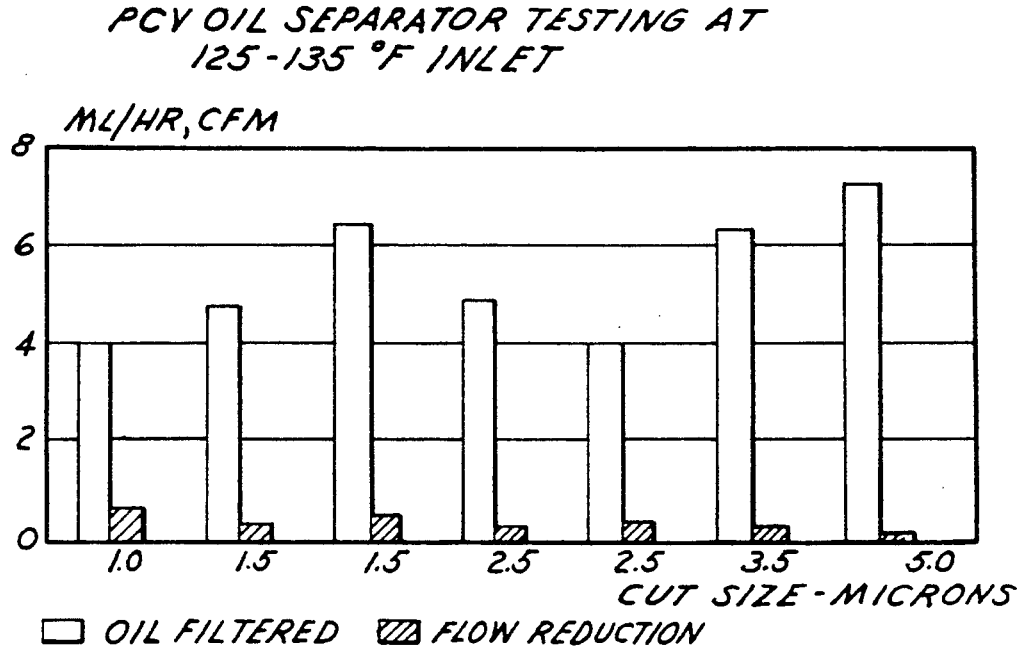
FIGS. 11 and 12 are charts of test results.
Figure 12:
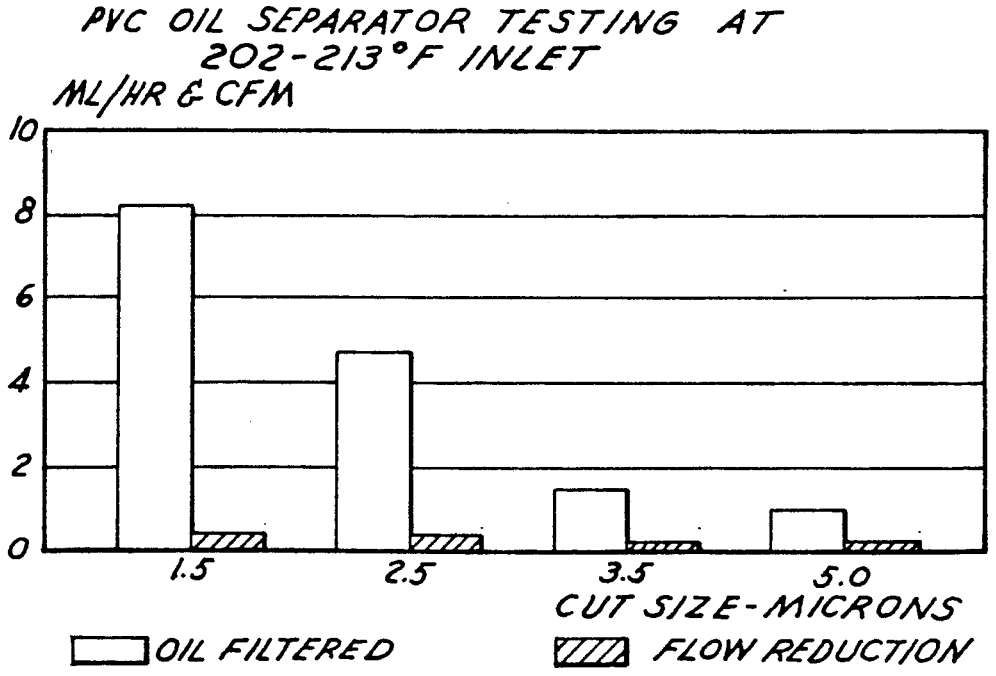

Test results on a production engine are shown in FIGS. 11 and 12. In FIG. 11, five variations in orifice size and plate spacing were utilized to produce minimum theoretical particle size selections (cut size) from one to five microns. Results indicate that at this inlet temperature (125°–135° F.), most particles are larger than five microns.

In FIG. 12, results at a higher inlet temperature of 202°–213° F. are shown. At this temperature, results indicate that approximately 60% of the particles are larger than 2.5 microns, about 20% of the particles are larger than 3.5 microns, and about 10% of the particles are larger than 5.0 microns.

These results indicate the necessity to combine inlet temperature control with inertial impactor design to collect the desired particles.

An example of the manner of design of an impactor comprised measuring PCV flow rates of 3 CFM at 190° F. from a test engine, and establishing a separator housing inside diameter of 1.625 inches based on some existing hardware. Using this data and assuming a rectangular slot height of 3 cm (1.181 inches), a Reynold's number was calculated. Using the Reynold's number, the critical Stokes number for a rectangular impactor was found. It was decided to design the first impactor for a cut size of 2.5 microns. Cut size is the theoretical, minimum, aerodynamic diameter of particles that will be collected or separated by the impactor. Particles smaller than this size will pass around the impactor plate and not be collected; while particles larger will strike the impactor plate and be collected. Using the desired cut size, the slot width was calculated. The ratio of distance between the orifice plate and impactor plate (D) to slot width (W), or D/W should be between 1.5 and 10. This defined the spacing (D) dimension. Inertial impactor cut size varies directly with slot width. Using this information, subsequent impactors were designed with cut sizes from 1 micron to 10 microns.

Inertial impactors were fabricated with cut sizes of 1.0, 1.5, 2.5, 3.5, and 5.0 microns. Later, cut sizes of 7.5 and 10 microns were also fabricated. To define the particle size present in the PCV gas stream, impactors of varying cut size were installed in the PCV line of a test engine; and impactor collection rate of oil, fuel, and water as well as flow loss was observed. During this testing, it was noted that the collection rate was significantly affected by PCV gas temperature; at higher temperature, collection rate decreased. This is due to a decrease in particle size with a change from the liquid to the gaseous state (boiling or vaporization). Because both oil and fuel are made up of a number of different hydrocarbons, this conversion occurs over a broad temperature range. (Each hydrocarbon boils at a different temperature.) This observation led to the concept of raising PCV gas temperature at the entry to the separator to convert particles of unwanted liquids (fuel and water) to a smaller diameter which would pass around the impactor plate and not be collected. By limiting this temperature to a level below the initial boiling point of oil, oil particle size would remain unchanged. Thus, larger oil particles will strike the impactor plate and be collected. The lower boiling or vaporization temperatures of fuel and water (when compared to oil) make this feasible.

It can thus be seen that there has been provided a PCV oil separator system wherein oil particles are separated from the PCV flow while fuel and water particles pass on through the system to re-enter the engine; wherein the modification to the conventional PCV oil separator system is minimal; wherein the modification may be made at low cost.

I claim:

1. In a positive crankcase ventilation system wherein a direct flow path of vapors is provided between the engine crankcase and the intake manifold by inducing differential pressure between the intake manifold and the crankcase, the method of separating oil from fuel and water in the vapor which comprises:

passing the vapors through at least one chamfered orifice, directing the vapors toward an impactor plate, impacting the vapors after they have passed through the orifice against an impactor plate, controlling the temperature of the vapors, the size of the orifice, the distance between the orifice and the impactor plate such that the oil particles are separated from the vapor and the remaining vapor containing fuel and water passes on through the system.

2. The method set forth in claim 1 wherein the step of heating the vapors comprises utilizing the heat of the engine, adding external heat, or a combination of both.

3. The method set forth in any one of claims 1 and 2 wherein the orifice and impactor plate are positioned in advance of the positive crankcase ventilation valve or downstream from the positive crankcase ventilation valve or internal to the engine.

4. The method set forth in claim 1 wherein said chamfered orifice is rectangular including the step of orienting said rectangular orifice such that its longest dimension extends vertically.

5. The method set forth in claim 1 wherein said step of controlling the temperature is sufficient to elevate the temperature of the oil to a level below the vaporization point of oil while elevating the temperature to above the vaporization point of the fuel and water.

6. In a positive crankcase ventilation system wherein a direct flow path of vapors is provided between the engine crankcase and the intake manifold by inducing differential pressure between the intake manifold and the crankcase, the improvement comprising an oil separator including an orifice positioned such that the vapors pass through the orifice, an impactor plate against which the vapors pass after passing through the orifice, and means for heating the vapors before passage through the orifice, the size of the orifice, the distance between the orifice and the impactor plate, and amount of heat being constructed and arranged such that the oil particles are separated from the PCV gas which with the fuel and water particles pass on through the system and re-enter the engine.

7. The system set forth in claim 6 wherein said means for heating the vapors comprises positioning the oil separator such that the engine provides the heat, additional external heater means or a combination of both.

8. The system set forth in claim 1 wherein said oil separator comprises a housing having an inlet and an outlet, said orifice plate and said impactor plate being positioned in said housing such that vapors pass through said inlet toward said orifice and through said orifice to said impactor plate and the oil particles are separated from the fuel and water particles and the fuel and water particles pass about said impactor plate to said outlet.

9. The system set forth in claim 8 wherein said impactor plate has a cross sectional area less than the cross sectional area of said housing.

10. The system set forth in claim 9 wherein said impactor plate includes vertical flanges along edges thereof for guiding the oil particles downwardly under the action of gravity.

11. The system set forth in claim 10 wherein said housing includes at least one drain opening.

12. The system set forth in claim 11 including valve means associated with said drain opening.

13. The system set forth in claim 8 wherein said orifice is rectangular.

14. The system set forth in claim 13 wherein said housing includes external indicia indicating the direction in which the separator should be positioned to orient the orifice vertically.

15. The system set forth in claim 8 wherein said housing includes indicia indicating the direction of flow through said separator.

16. An oil separator for use in a positive crankcase ventilation system wherein a direct flow path of vapors is provided between the engine crankcase and the intake manifold by inducing differential pressure between the intake manifold and the crankcase, said oil separator including an orifice positioned such that the vapors pass through the orifice, an impactor plate against which the vapors pass after passing through the orifice, and means for heating the vapors before passage through the orifice and, the size of the orifice and distance between the orifice and the impactor plate, and amount of heat being constructed and arranged such that the oil particles are separated from the PCV gas which with the fuel and water particles pass on through the system and re-enter the engine.

17. The oil separator set forth in claim 16 wherein said means for heating the vapors comprises positioning the oil separator such that the engine provides the heat, additional external heater means or a combination of both.

18. The oil separator set forth in claim 16 wherein said oil separator comprises a housing having an inlet and an outlet, said orifice plate and said impactor plate being positioned in said housing such that vapors pass through said inlet toward said orifice and through said orifice to said impactor plate and the oil particles are separated from the fuel and water particles and the fuel and water particles pass about said impactor plate to said outlet.

19. The oil separator set forth in claim 18 wherein said impactor plate has a cross sectional area less than the cross sectional area of said housing.

20. The oil separator set forth in claim 19 wherein said impactor plate includes vertical flanges along edges thereof for guiding the oil particles downwardly under the action of gravity.

21. The oil separator set forth in claim 20 wherein said housing includes at least one drain opening.

22. The oil separator set forth in claim 21 including valve means associated with said drain opening.

23. The oil separator set forth in claim 18 wherein said orifice is rectangular.

24. The oil separator set forth in claim 23 wherein said housing includes external indicia indicating the direction in which the separator should be positioned to orient the orifice vertically.

25. The oil separator set forth in claim 18 wherein said housing includes indicia indicating the direction of flow through said separator.

* * * * *